US005581845A

United States Patent [19]

Yang

[11] Patent Number: 5,581,845

[45] Date of Patent: Dec. 10, 1996

[54] HANDLE FOR GARDEN TOOL

[76] Inventor: Syh-Yn Yang, P.O. Box 53-8, Taichung, Taiwan

[21] Appl. No.: 445,709

[22] Filed: May 22, 1995

[51] Int. Cl.[6] ..... B25G 1/00

[52] U.S. Cl. ..... 16/110 R; 16/114 R; 16/DIG. 12

[58] Field of Search ..... 16/110 R, 114 R, 16/110.5, DIG. 12, DIG. 18, DIG. 19; 294/57; 56/DIG. 18; 81/177.1, 489

[56] References Cited

U.S. PATENT DOCUMENTS

| | | | |
|---|---|---|---|
| D. 282,710 | 2/1986 | Vosbikian | 16/DIG. 12 |
| 1,632,227 | 6/1927 | Halsey | 81/177.1 |
| 2,162,117 | 6/1939 | Perry | 16/DIG. 12 |
| 2,567,565 | 9/1951 | Keeler et al. | 16/110 R |
| 3,189,069 | 6/1965 | Stowell | 81/177.1 |
| 3,271,856 | 9/1966 | Rowley | 16/110 R |
| 3,340,914 | 9/1967 | Ricks | 16/DIG. 12 |
| 4,031,775 | 6/1977 | Petty | 16/110 R |
| 4,969,231 | 11/1990 | Mader et al. | 81/177.1 |
| 4,974,286 | 12/1990 | Stowell et al. | 16/114 R |
| 5,008,970 | 4/1991 | Tsai | 16/110 R |
| 5,027,511 | 7/1991 | Miller | 16/110 R |
| 5,056,381 | 10/1991 | Carmein | 16/110 R |
| 5,299,475 | 4/1994 | Stroop | 16/110 R |
| 5,398,369 | 3/1995 | Heinzelman et al. | 81/489 |
| 5,400,511 | 3/1995 | Decker | 16/114 R |

*Primary Examiner*—M. Rachuba
*Assistant Examiner*—Donald M. Gurley

[57] ABSTRACT

A handle for a garden tool includes two side walls having a depression formed in the upper and front portion. A sleeve of resilient materials is engaged on the handle and includes a recess formed in the upper and front portion and located above the depression of the handle. A number of projections are extended upward from the recess and located above the depression such that the resilience of the projections are increased for engaging with the users.

1 Claim, 3 Drawing Sheets

HANDLE FOR GARDEN TOOL

BACKGROUND OF THE INVENTION

1. Field of the Invention

The present invention relates to a handle, and more particularly to a handle for garden tool.

2. Description of the Prior Art

Typical garden tools, such as shovel, comprise a handle that is made of metal or plastic materials having high rigidity such that the users may not feel comfortable when holding the handles.

The present invention has arisen to mitigate and/or obviate the afore-described disadvantages of the conventional garden tools.

SUMMARY OF THE INVENTION

The primary objective of the present invention is to provide a handle for garden tools in which the handle includes a resilient hand grip that may be held with comfort.

In accordance with one aspect of the invention, there is provided a handle assembly for a garden tool comprising a body for engaging with the garden tool, the body including two side walls having an upper portion and having a plurality of reinforcing ribs secured therebetween, the reinforcing ribs including an upper portion slightly lower than the upper portion of the side walls so as to define a depression between the side walls and the reinforcing ribs, and a sleeve engaged on the body and including an upper and front portion having a recess formed therein, and including a plurality of projections extended upward from the recess, the sleeve being made of resilient materials, and the projections being located above the depression.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
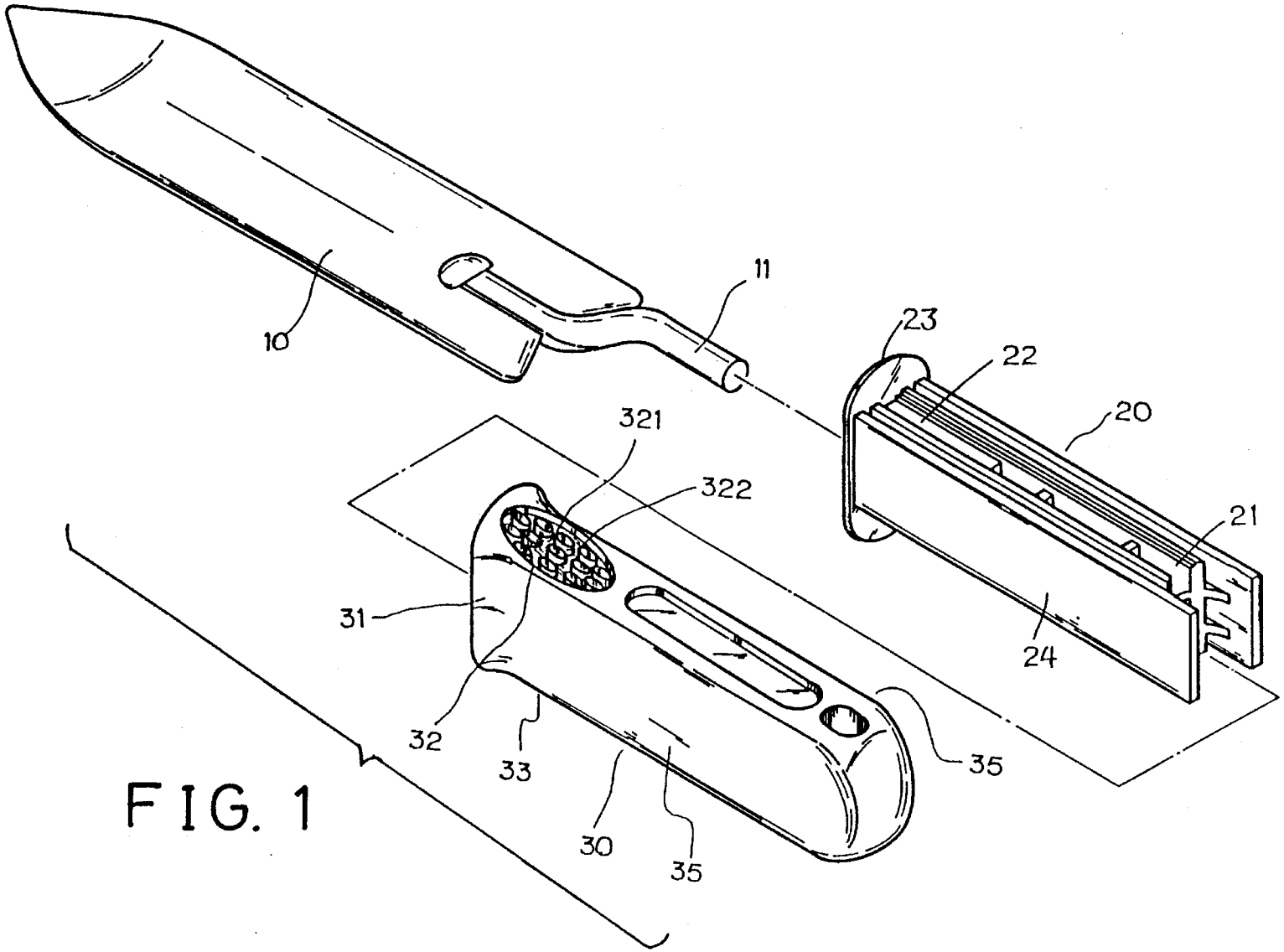
FIG. 1 is an exploded view of a handle for garden tool in accordance with the present invention.
Figure 3:
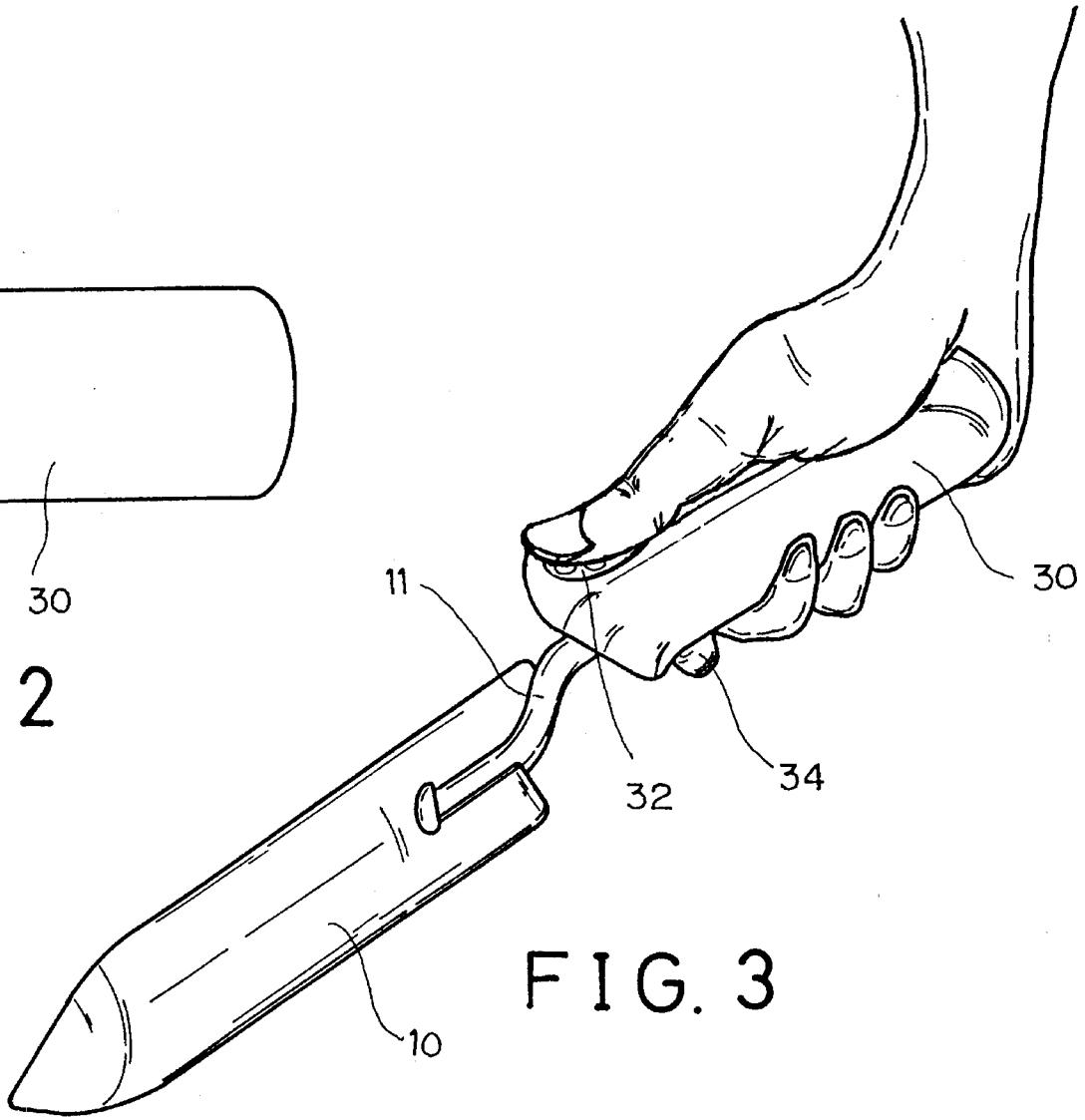
FIG. 3 is a perspective view illustrating the operation of the handle.
Figure 2:
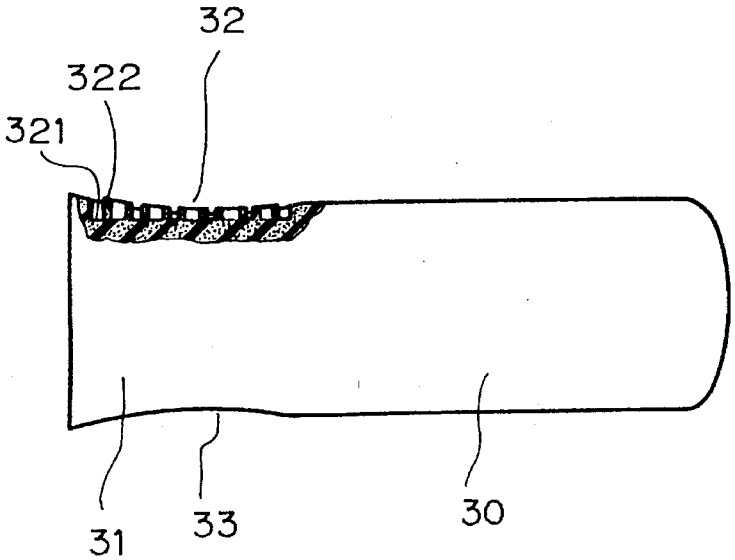
FIG. 2 is a partial cross sectional view of a sleeve.

Referring to the drawings, and initially to FIGS. 1 to 3, a handle for a garden tool in accordance with the present invention comprises a body 20 for engaging with an extension 11 of a garden tool 10. The body 20 includes a number of reinforcing ribs 21 coupled between a pair of side walls

24 and includes an end wall 23 formed in the front portion. The reinforcing ribs 21 have an upper portion slightly lower than the side walls 24 so as to define a depression 22 in the front and upper portion of the body 20.

A sleeve 30 includes a front portion 31 for engaging onto the body 20 and includes two side portions 35, an upper portion 32 and a bottom portion 33. The sleeve 30 includes a recess 321 formed in the front portion of the upper portion 32 and includes a number of projections 322 extended upward from the recess 321 for engaging with the finger of the users, particularly the thumb, as shown in FIG. 3. It is preferable that the projections 322 have an upper portion flush with the upper surface of the upper portion 32.

It is to be noted that the sleeve 30 is made of resilient materials, such as rubber. The projections 322 are located above the depression 22 of the body 20 such that the resilience of the sleeve 30, particularly the resilience of the projections 322 are further improved. The recess 321 and the projections 322 may also be formed in the side portions 35 or in the bottom portion 33 for engaging with the other portions of the palm of the user.

Figure 6:
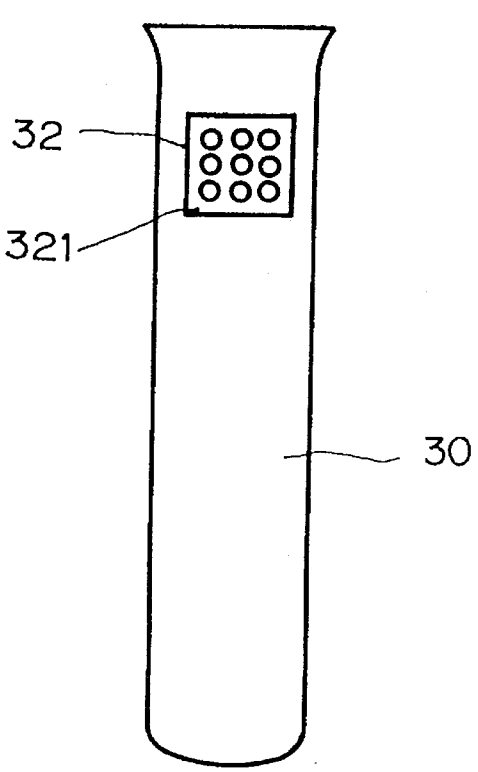
FIGS. 4, 5, 6 are plane views illustrating another applications of the hand grip.
Figure 4:
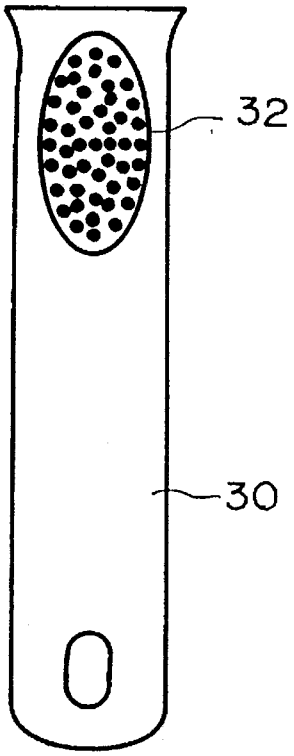
Figure 5:
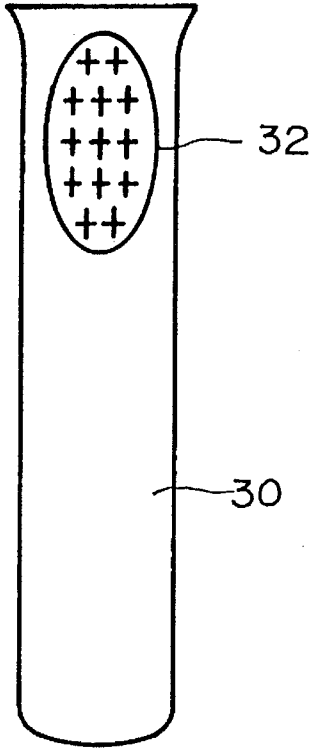

Referring next to FIGS. 4 to 6, the projections 322 may be a number of semi-spherical shaped bulges (FIG. 4) and may be cross shaped (FIG. 5). The recess 321' may include different shape, such as rectangular shape (FIG. 6).

Accordingly, the handle of the garden tool in accordance with the present invention includes a resilient structure that may be held with excellent comfortableness.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A handle assembly for a garden tool comprising:

a body for engaging with the garden tool, said body including two side walls having an upper portion and having a plurality of reinforcing ribs secured therebetween, said reinforcing ribs including an upper portion slightly lower than said upper portion of said side walls so as to define a depression between said side walls and said reinforcing ribs, and a sleeve including a front portion for engaging onto said body and including two side portions and an upper portion and a bottom portion, said upper portion of said sleeve being located above said depression of said body and including a front portion having a recess formed therein, said sleeve including a plurality of projections extended upward from said recess for engaging with a finger of a user, said sleeve being made of resilient materials, and said projections of said sleeve being located above said depression so as to increase a resilience of said projections.

* * * * *